US007832183B2

(12) United States Patent
Jacob et al.

(10) Patent No.: US 7,832,183 B2
(45) Date of Patent: Nov. 16, 2010

(54) PACKAGING MACHINE WITH PIVOTING MINOR FLAP RETAINER

(75) Inventors: Jeffrey G. Jacob, Buford, GA (US); John W. Cash, III, Dallas, GA (US); Michael F. Flagg, Newnan, GA (US)

(73) Assignee: MedWestvaco Packaging Systems, LLC, Richmond, VA (US)

( * ) Notice: Subject to any disclaimer, the term of this patent is extended or adjusted under 35 U.S.C. 154(b) by 0 days.

(21) Appl. No.: 12/466,043

(22) Filed: May 14, 2009

(65) Prior Publication Data

US 2009/0277134 A1 Nov. 12, 2009

Related U.S. Application Data

(62) Division of application No. 11/940,827, filed on Nov. 15, 2007, now abandoned.

(60) Provisional application No. 60/866,028, filed on Nov. 15, 2006.

(51) Int. Cl.
*B65B 7/00* (2006.01)

(52) U.S. Cl. ..... 53/376.4; 53/482; 53/378.3; 53/207

(58) Field of Classification Search ..... 53/376.3, 53/397, 462, 482, 580, 378.3, 207, 209, 222, 53/376.4, 376.7, 377.2, 377.8, 387.2
See application file for complete search history.

(56) References Cited

U.S. PATENT DOCUMENTS

| | | | | | |
|---|---|---|---|---|---|
| 4,480,421 | A | * | 11/1984 | Rece | 53/75 |
| 4,919,266 | A | * | 4/1990 | McIntosh et al. | 206/434 |
| 5,188,695 | A | * | 2/1993 | Colton | 156/356 |
| 5,328,030 | A | * | 7/1994 | Sutherland | 206/429 |
| 5,417,032 | A | | 5/1995 | Calvert | |
| 5,582,663 | A | * | 12/1996 | Matsunaga | 156/64 |
| 5,664,401 | A | | 9/1997 | Portrait et al. | |
| 5,778,630 | A | | 7/1998 | Portrait et al. | |
| 6,019,220 | A | * | 2/2000 | Sutherland | 206/427 |
| 7,000,365 | B2 | * | 2/2006 | Nutley et al. | 53/397 |
| 7,517,307 | B2 | * | 4/2009 | Pokusa et al. | 493/128 |
| 2006/0272777 | A1 | | 12/2006 | Buda | |

FOREIGN PATENT DOCUMENTS

| | | |
|---|---|---|
| EP | 0322159 B1 | 8/1992 |
| EP | 1123236 B1 | 4/2004 |

* cited by examiner

*Primary Examiner*—Hemant M Desai
(74) *Attorney, Agent, or Firm*—MWV Intellectual Property Group

(57) ABSTRACT

A packaging apparatus in an automated packaging process, for sealing a carton having minor flaps and a bottom end flap, comprising: means for holding the minor flaps in a closed position; and a cycle stop compression plate for, upon the occurrence of a cycle stop operation, folding the bottom end flap over the minor flaps and holding the bottom end flap in place until the carton is sealed.

6 Claims, 11 Drawing Sheets

PACKAGING MACHINE WITH PIVOTING MINOR FLAP RETAINER

RELATED APPLICATION

This application is a divisional of U.S. patent application Ser. No. 11/940,827, filed Nov. 15, 2007, now abandoned which claims priority to U.S. Provisional Patent Application No. 60/866,028, filed Nov. 15, 2006, both of which applications are hereby incorporated by reference.

TECHNICAL FIELD

This disclosure relates generally to packaging machinery and systems and, more specifically, to packaging machine improvements for enabling the automated packaging of cartons having narrow wrap-around minor and bottom flaps.

BACKGROUND OF THE INVENTION

Machines for packaging products such as beverage cans, or bottles in paperboard cartons are known in the art. Typically, a conveyor system transports the products to be packaged toward a loading mechanism which can push the products into open ends of a partially constructed carton. As the loaded carton is transported further along the conveyor path, an adhesive, such as hot glue, is applied to flaps of the open carton ends, which are then pressed closed by structures or mechanisms further down the conveyor path from the glue applying mechanisms of the machine. The packed and closed carton can then be shipped for retail sale.

Packaging machines are generally designed to handle certain carton configurations. Adjustable elements provided on the machine allow for some reconfigurations of the machine, but cartons packed by these reconfigurable machines usually share certain characteristics required for the machine to be able to successfully pack and close the cartons. Given the size, cost, and complexity of these machines, it is advantageous to design machines that are as versatile in their compatibility with varying carton configurations as possible.

Designing reconfigurable machines poses challenges beyond just creating machines that will successfully pack and load a carton traveling from loading mechanisms through gluing mechanisms and past closing mechanisms in a continuous pass. In some circumstances, the conveyor machinery may be stopped while there are cartons in various stages of packaging. The conveyor may be stopped, for example, at end of a worker's shift, at the end of a work day, or because of an issue occurring along the conveyor path, such as a misfed carton. Such a conveyor stoppage is referred to herein as a "cycle stop." In these instances, there can be cartons along the conveyor path which have had glue applied to their end flaps, but have not yet had their end flaps pressed closed. During the delay between the application of the glue and the restarting of the conveyor, the glue can cool or cure, preventing adhesion of the end flaps. Merely restarting the conveyor will lead to the end of these cartons being pressed closed, but if the glue has already set and/or cured, carton construction may be unsuccessful.

Some packaging machine designs include cycle stop functions that can be operated to successfully close these cartons following a conveyor stoppage, prior to the glue cooling or curing. A versatile carton packaging machine design, therefore, also requires that cycle stop functions of the machine be compatible with the various carton configurations packaged by the machine.

Generally, the end flaps are the elements that are manipulated as the carton is packed, glued, and closed. The end flap dimensions of certain carton configurations can pose difficulties in versatile packaging machine design. For instance, some packaging machines are designed to be reconfigurable to glue different end flap configurations by selectively deactivating one or more glue guns, which often causes the deactivated glue gun to clog after a period of nonuse. Some difficulties are great enough that certain carton configurations must be hand packed. Such manual processes add considerable time and expense such that these cartons may be used less commercially than they would otherwise be if the packaging process could be automated.

SUMMARY

The present disclosure describes a packaging apparatus for use in a packaging machine that facilitates proper closure of cartons of various configurations and sizes, particularly in a continuous packaging process that at least occasionally stops while cartons are undergoing various stages of the process.

Generally described, the packaging apparatus includes a rotating glue gun assembly, as well as means for holding minor flaps and means for folding a bottom end flap for use in connection with a cycle stop operation capability. The cycle stop operation allows carton packaging operations to be halted at any time. When a cycle stop operation is initiated, a finishing process completes any time-sensitive parts of the packaging process, such as gluing and closing end flaps, in process when the cycle stop operation is initiated. When packaging operations are later resumed, the processing of all of the packages in progress when the cycle stop operation was commenced can be successfully completed.

When a cycle stop operation is initiated, a compression plate is actuated by extension of a pneumatic cylinder. The compression plate is brought into contact with the bottom end flap of a carton to which glue has been applied. The compression plate folds the end flap into a closed position and, in conjunction or coordination with means for hold minor flaps, holds the minor and end flaps closed until the glue has set or until normal packaging operations are resumed. This prevents the glue on the end flaps from curing before the end flaps are closed.

The rotating glue gun assembly allows rotation of two or more glue guns prior to commencing or during packaging operations. The rotation of the glue gun assembly and the glue guns provides adjustable application of one or more glue beads without having to deactivate any of the glue guns for an extended time. The ability to adjust glue application allows the packaging machine to be configured to accommodate various package configurations. In addition to being able to vary the number of applied glue beads, the rotating glue gun assembly allows adjustment of the distance between the applied glue beads, according to desired specifications.

Specifically, certain embodiments of the packaging apparatus include a rotating glue gun assembly. The rotating glue assembly has at least a first glue nozzle and a second glue nozzle for placing glue beads on a carton being packaged by the packaging machine. The location of the placed glue beads can be adjusted by rotation of the glue gun assembly, and thereby, of the first and second glue nozzles.

According to an aspect of the disclosure, the glue gun assembly can be rotated through ninety degrees or more. Thereby, the glue nozzles can be selectively positioned and aligned to provide the desired number of lines of glue at the desired spacing. To apply fewer lines of glue than the number of glue nozzles, at least two of the glue nozzles can be rotated to be in line with one another to apply one of the desired lines of glue.

For example, a first orientation of the glue gun assembly permits the first and second glue beads to be placed on the carton along two substantially parallel lines. The spacing between the two substantially parallel lines, and therefore, the glue beads, is substantially equal to the linear distance between a first nozzle outlet of the first glue nozzle, and a second nozzle outlet of the second glue nozzle.

A second orientation of the glue gun assembly, achieved by rotating the glue gun assembly approximately 90 degrees in either direction, aligns the first and second glue nozzles to overlay or alternatingly apply a glue bead from each glue nozzle so that the glue is placed on a carton along a single line.

In certain embodiments, the first glue nozzle and the second glue nozzle can be separately actuated to cause the first glue nozzle to apply a first glue bead to a carton, and the second glue nozzle to apply a second glue bead to the carton. Either or both of the first glue bead and the second glue bead can be continuous or discontinuous, as dictated by the particular application.

A third orientation of the glue gun assembly, achieved by rotating the glue gun assembly to some extent but less than 90 degrees, permits glue beads to be placed along a second set of two substantially parallel lines. The spacing between the second set of two substantially parallel lines can be less than the linear distance between the first nozzle outlet and the second nozzle outlet.

According to one aspect, the packaging apparatus includes a retaining guide and/or a retaining bar, along with a cycle stop compression plate. The retaining bar and the retaining guide function either alone or in combination as means for holding minor flaps in place during normal operation and in the initial stage of a cycle stop operation. In certain embodiments, the retaining guide moves pivotably in response to a cycle stop operation to avoid contacting a bottom end flap of the carton as it is positioned by the cycle stop compression plate. More specifically, the retaining guide retracts during its movement to avoid contact with the carton.

In certain embodiments, the movement of the retaining guide is caused by contact between a cam bar and a pivoting member of a retaining guide assembly. According to an aspect of these embodiments, the movement of the retaining guide is caused by a force, such as that exerted by an actuation cylinder on a pivoting member of a retaining guide assembly.

The foregoing has broadly outlined some of the aspects and features of the present disclosure, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

As required, detailed embodiments of the present disclosure are disclosed herein. It must be understood that the disclosed embodiments are merely exemplary of the disclosure that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Figure 1:
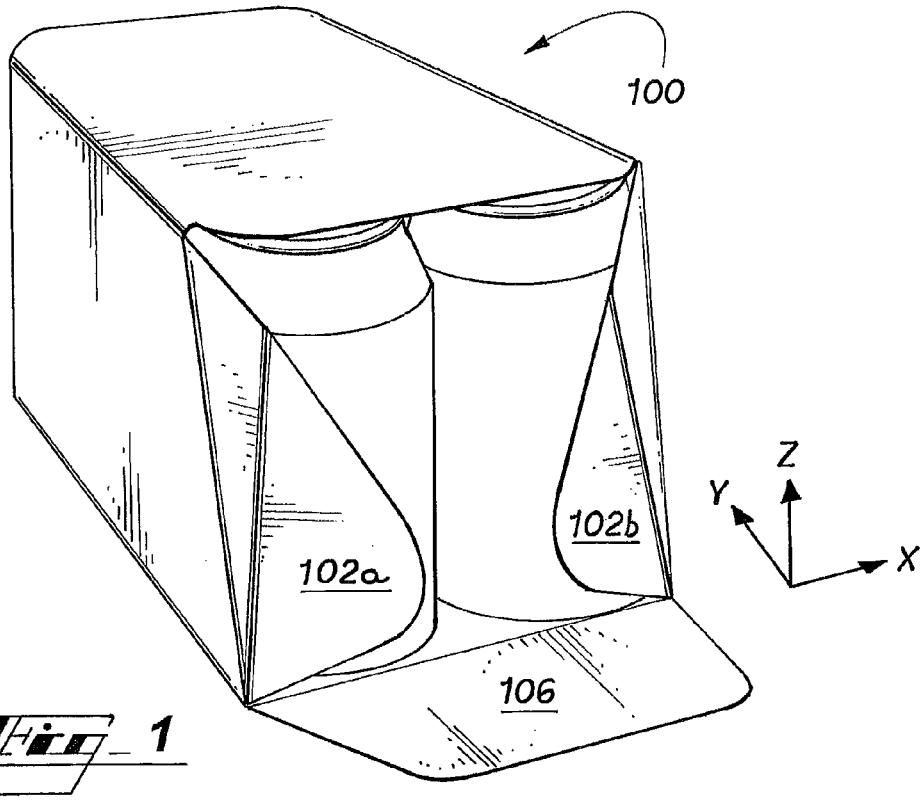
FIG. 1 is a perspective view of an exemplary carton before packaging.

Referring now to the drawings, wherein like numerals indicate like elements throughout the several views, the drawings illustrate certain of the various aspects of an exemplary embodiment of a packaging machine that includes mechanisms for automated packaging of various carton configurations, particularly those having relatively narrow end flaps. FIG. 1 illustrates a carton 100 having side end flaps 102*a* and 102*b* (the side end flaps are hereinafter referred to as minor flaps) and bottom flap 106. As described below, the relative end flap dimensions of the carton 100 are conducive to gluing and closing by prior art packaging machines.

Figure 2:
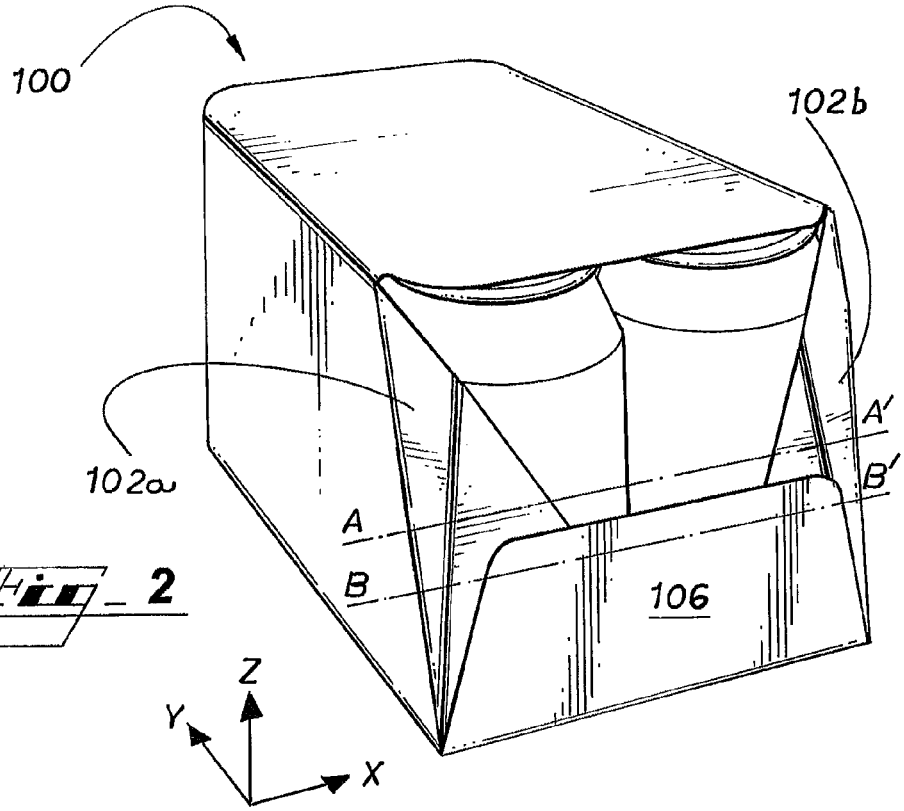
FIG. 2 is a perspective view of the carton of FIG. 1 after packaging.

FIG. 2 illustrates a carton 100 after the carton 100 has been packed, glued, and closed. A set of mutually perpendicular axes (X, Y, Z) is shown to facilitate the following explanation. The X axis lies substantially parallel to the width of the carton and the direction of travel of the carton as it moves along a packaging machine conveyor. The Y axis lies substantially parallel to the length of the carton, and the Z axis lies substantially parallel to the height of the carton. As can be seen in FIG. 2, there are locations along the height of the carton where a line A-A' can be drawn that will cross the minor flaps 102*a*, 102*b* without crossing the bottom flap 106. A packaging machine designed to glue and close carton 100 can implement a retaining bar, or other mechanism that lies against the carton at the position of line A-A' to hold minor flaps 102*a*, 102*b* in a closed position without interfering with the closing of the bottom flap 106. Such a retaining bar can include, for example, a static bar that, due to the motion of the conveyor and a bend of the bar, contacts the minor flaps and gradually pushes them to a closed position. In addition, glue can be applied to the minor flaps 102*a*, 102*b* below the line A-A' without interference from a retaining bar located at A-A'. A second retaining bar or mechanism can be implemented down the conveyor path from the gluing mechanism which can similarly contact and press the bottom flap 106 closed. As can be seen in FIG. 2, a retaining bar at A-A' can hold the minor flaps 102*a*, 102*b* closed without interfering with the closing of the bottom flap 106 using a retaining bar or mechanism at B-B'. The carton 100 having minor flaps 102*a*, 102*b* with dimensions in the Z direction which are greater than the dimension in the Z direction of the bottom flap 106 (when folded closed) can be glued and closed in the manner described above.

Figure 3:
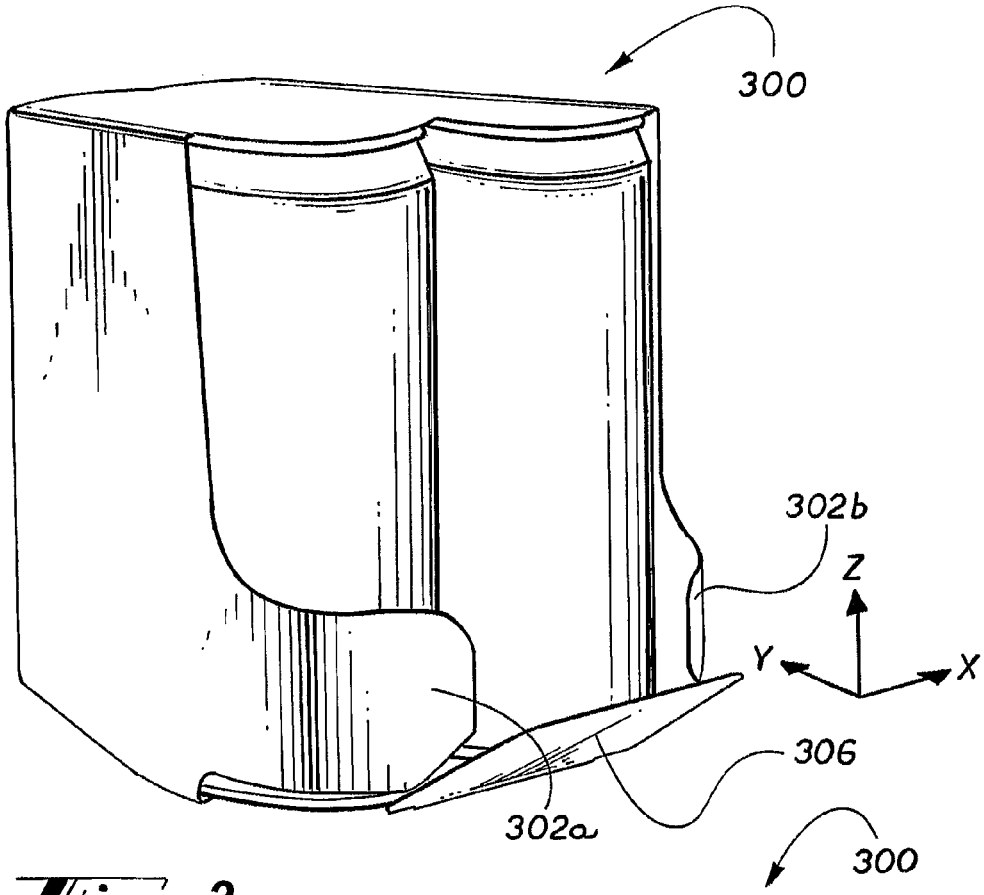
FIG. 3 is perspective view of another exemplary carton before packaging.
Figure 4:
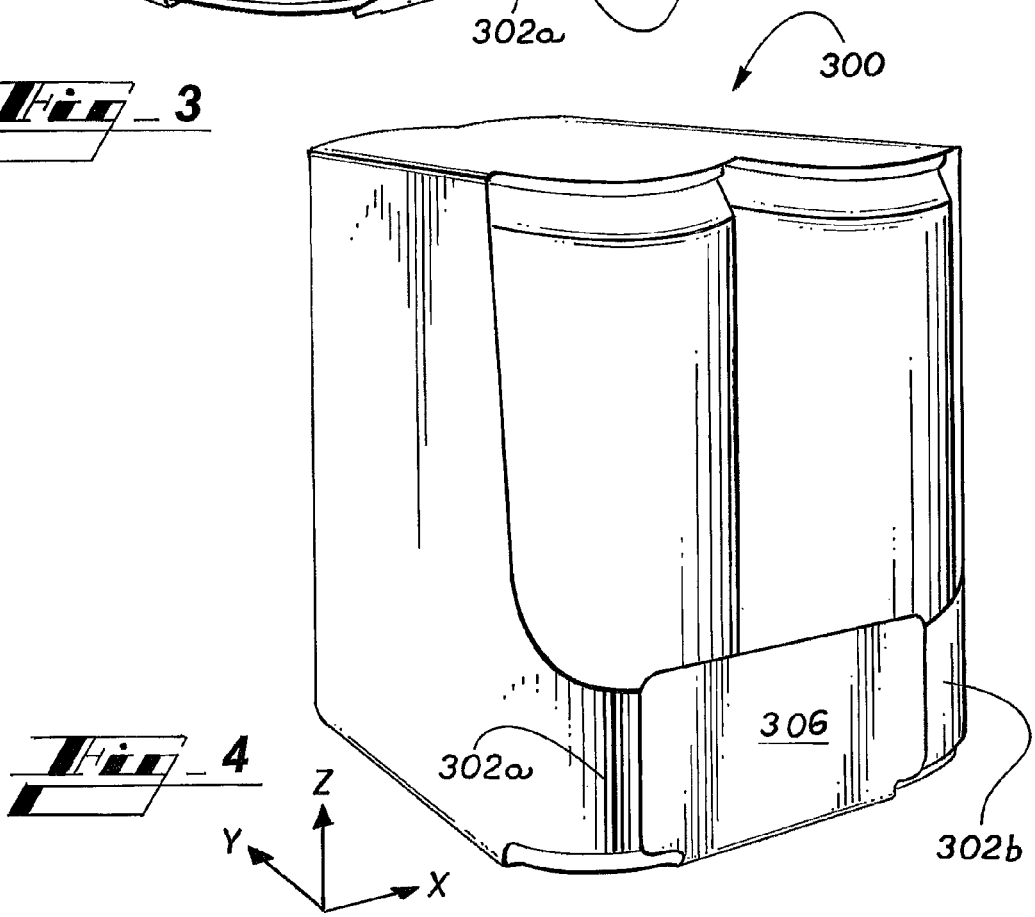
FIG. 4 is a perspective view of the carton of FIG. 3 after packaging.

FIG. 3 depicts a carton 300 having minor flaps 302*a*, 302*b* and bottom flap 306. The minor flap 302*a*, 302*b* dimensions of a carton 300 pose more difficulties in designing a machine for automated packaging than those of the carton 100. FIG. 4 shows the carton 300 after the end shown has been glued, and closed. It can be seen that there is no location along the height of the carton 300 (in the Z direction) where the minor flaps 302*a*, 302*b* can be held closed by a first retaining mechanism while the bottom flap 306 is simultaneously closed by a second retaining mechanism without the first interfering with the second. The difficulty is created by the minor flaps 302*a*, 302*b* having dimensions along the Z axis which are equal to or less than the dimension along the same axis of the bottom flap 306 (when closed). Carton configurations similar to carton 300 in this respect are often packed by hand due to these difficulties.

The present disclosure includes a modified packaging machine capable of packaging products in a carton such as carton 100, and that can be reconfigured by an operator to package products in a carton such as carton 300. The machine includes modified glue delivery and cycle stop mechanisms that are capable of operator reconfiguration for use with both carton 100 and carton 300.

Figure 5:
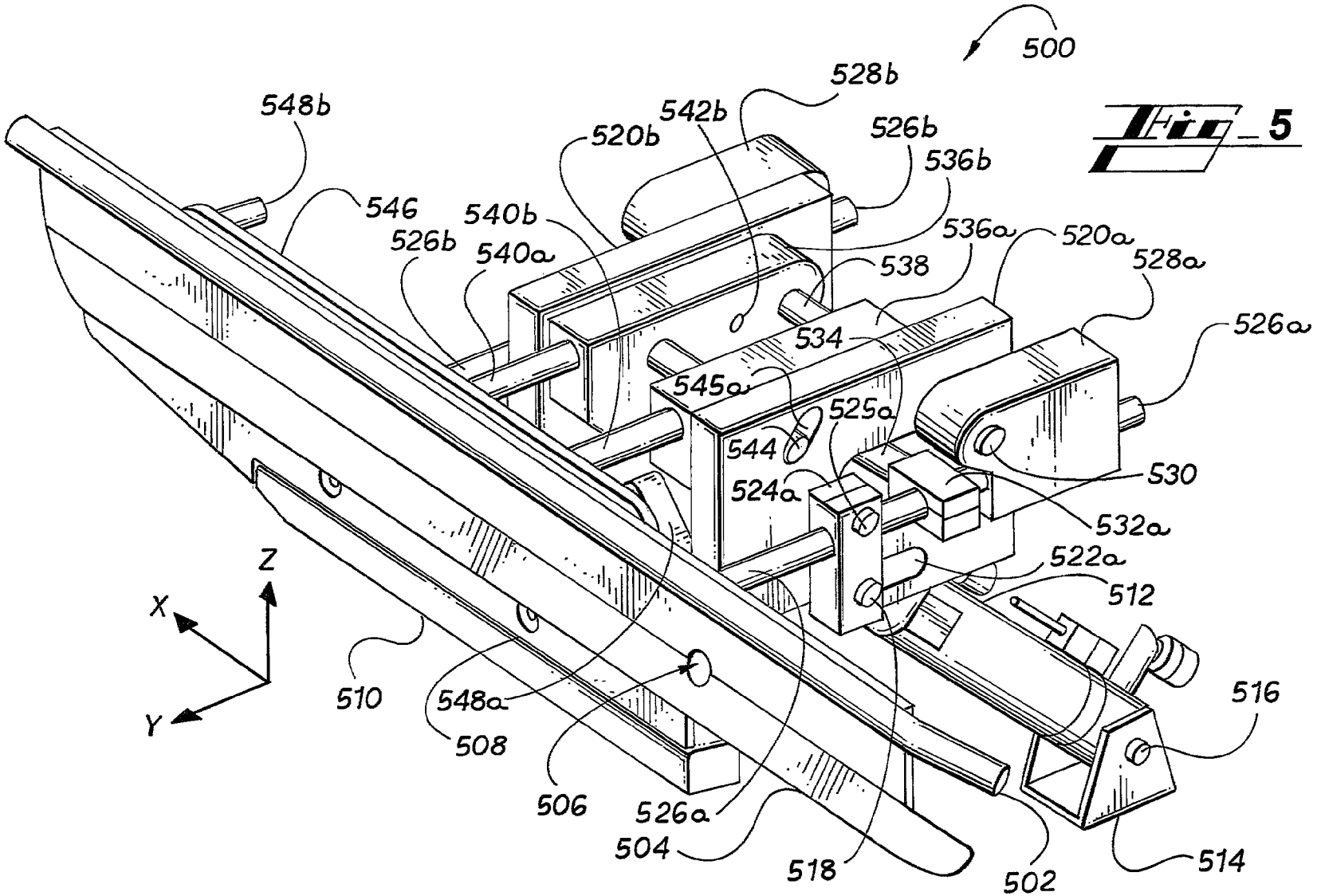
FIG. 5 is a perspective view of a packaging apparatus according to an exemplary embodiment of the disclosure.

The packaging apparatus 500 of FIG. 5 includes exemplary embodiments of modified glue delivery and cycle stop mechanisms. The packaging apparatus 500 includes a retaining bar 502 and a retaining guide 504. The retaining guide includes a glue nozzle access hole 506. The apparatus further includes a cycle stop compression plate 508 and a spring-loaded compression bar 510.

Movement of the apparatus during operation is driven at least in part by the actuation cylinder 512. The actuation cylinder 512 can include a pneumatically actuated piston, a hydraulically actuated piston, or any actuation mechanism capable of providing a linear force. A first end of the actuation cylinder 512 is attached at a lower pivot point 516 on a mounting bracket 514. A second end of the actuation cylinder 512 is pivotally attached to a track bar 518.

The track bar 518 is so named because it follows a path defined by a track cut into the plates 520*a*, 520*b* over the motion range provided by the actuation cylinder 512. The track bar 518 also passes through the pinch blocks 524*a*, 524*b* (524*b* is not visible from the perspective shown). The pinch blocks 524*a*, and 524*b* serve to provide a connection between the track bar 518 and the cycle stop compression plate slide rods 526*a*, 526*b* ("slide rods"). The bolts 525*a*, 525*b* (525*b* is not visible from the perspective shown) can be loosened to provide an adjustment range for movement of the cycle stop compression plate 508. The slide rods 526*a*, 526*b* are free to slide through tunnels in the cycle stop compression plate pivot blocks 528*a*, 528*b* ("pivot blocks"). The pivot blocks 528*a*, 528*b* rotate about pivot bar 530.

The pinch blocks 532*a*, 532*b* serve to provide an adjustable connection between the slide rods 526*a*, 526*b* and the cam bar 534. The bolts 533*a*, 533*b* (533*b* is not visible from the perspective shown) of the pinch blocks 532*a*, 532*b* can be loosened to move the cam bar fore or aft. During operation of the actuation cylinder 512, movement of the slide rods 526*a*, 526*b* causes the cam bar 534 to move forward and contact a bottom surface of the retaining bar pivot blocks 536*a*, 536*b*. Further forward motion of the cam bar 534 (in the Y direction) causes the pivot blocks 536*a*, 536*b* to rotate about the pivot bar 530. The pivot blocks 536*a*, 536*b* can include tunnels for the retaining bar slide rods 540*a*, 540*b*. The pivot blocks 536*a*, 536*b* can also include air holes 542*a*, 542*b* (542*a* is not visible from the perspective shown) to permit the slide rods 540*a*, 540*b* to slide the pivot blocks 536*a*, 536*b* without creating a high or low pressure area (relative to the ambient pressure) in the pivot block tunnels. The track bar 544 passes through the plates 520*a*, 520*b*, and the pivot blocks 536*a*, 536*b*. The track bar 544 follows the tracks 545*a*, 545*b* in the plates 520*a*, 520*b* respectively (545*b* is not visible from the perspective shown). The slide rods 540*a*, 540*b* can include rounded notches (not visible) that rest on the track bar 544 in the pivot block 536*a*, 536*b* tunnels. Rotation of the pivot blocks 536*a*, 536*b* causes the track bar 544 to follow the tracks 545*a*, 545*b* to retract the slide rods 540*a*, 540*b* into the pivot blocks 536*a*, 536*b*.

The retainer mounting plate 546 is mounted to the slide rods 540*a*, 540*b*. The retainer mounting plate 546 has a rear surface that lies in a plane perpendicular to the slide rods 540*a*, 540*b*. Thumb screws 548*a*, 548*b* are used to connect the retaining bar 502 and the retaining guide 504 to the mounting plate 546. An operator can loosen the thumb screws 548*a*, 548*b* to adjust the height (in the Z direction) of the retaining bar 502 and the retaining guide 504. An operator can remove the thumb screws 548*a*, 548*b* to mount retaining bars and/or retaining guides having different dimensions to pack various carton designs.

The apparatus 500 is positioned next to a conveyor (not shown) carrying cartons that have been loaded but still have open ends. Conveyor motion can be substantially parallel to and in the direction of the X axis shown in FIG. 5. The interactions of the various elements of the apparatus will be described in more detail below.

Figure 6:
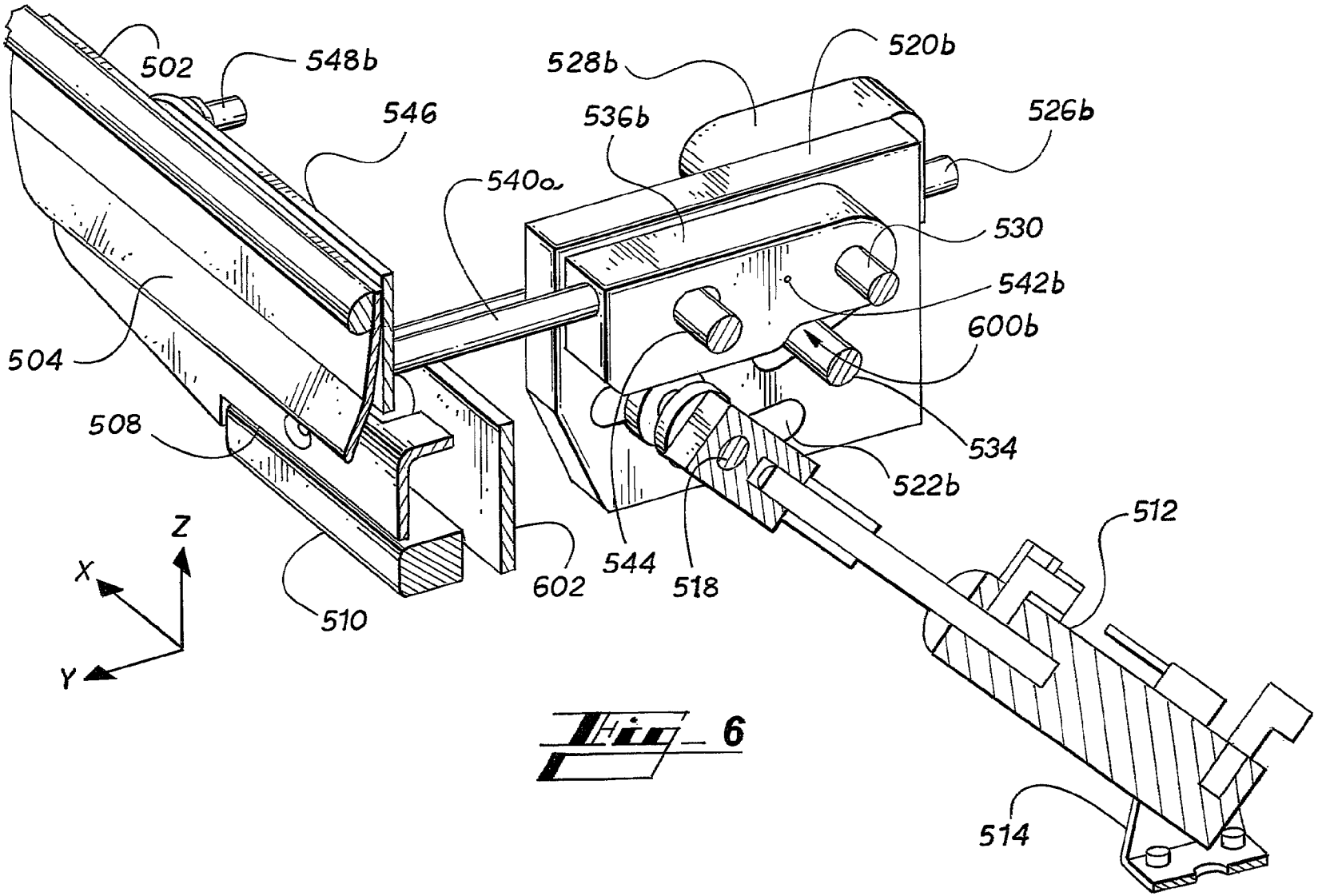
FIG. 6 is a sectional view of the packaging apparatus of FIG. 5.

FIG. 6 shows a perspective sectional view of the packaging apparatus 500. The view is cut near the middle of the track bar 518 and the actuation cylinder 512. This view of the apparatus shows the surface 600*b* of the pivot block 536*b* which is contacted by the cam bar 534 during operation of the apparatus. Additionally, a spring-loaded compression bar mounting plate 602 ("mounting plate") can be seen in this view. The mounting plate 602 connects the spring-loaded compression bar 510 to the slide rods 526*a*, 526*b*.

Figure 7:
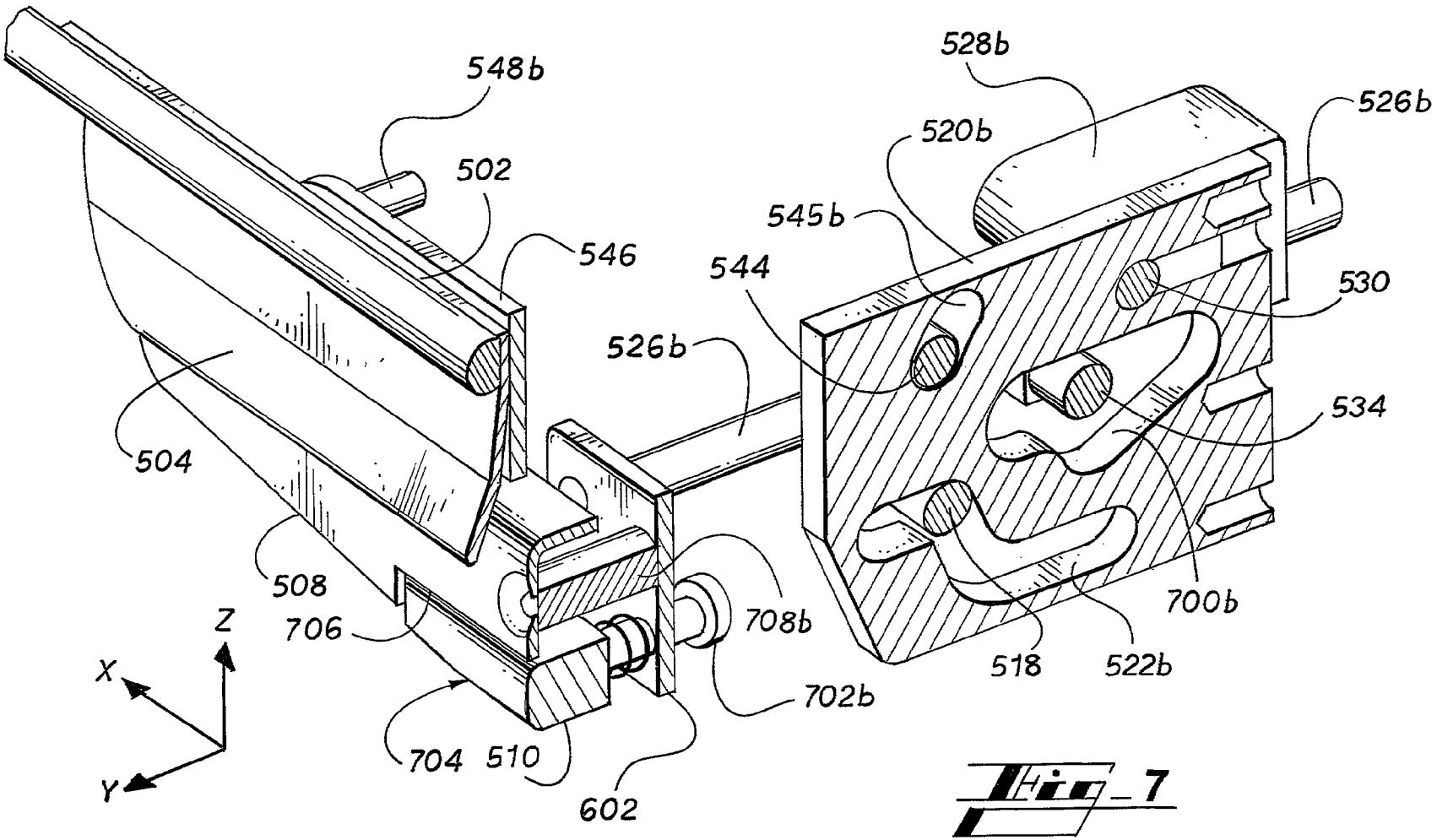
FIG. 7 is another sectional view of the packaging apparatus of FIG. 5.

FIG. 7 shows another perspective sectional view of the packaging apparatus. The view shown in FIG. 7 is cut through the plate 520*b*. This view clearly shows the track 522*b*, the track 545*b*, and the cam bar clearance area 700*b*. The cam bar clearance areas 700*a*, 700*b* (700*a* is not visible in the perspective shown) are areas of the plates 520*a*, 520*b* where plate material has been removed to prevent the cam bar 534 from contacting the plates 520*a*, 520*b* through the range of motion of the cam bar 534 during the operation of the apparatus 500. Also shown in this view is an adjustable spring-loaded compression bar shaft 702*b* ("shaft"). The adjustment provided by the shaft 702*b* can set the position of a face 704 of the spring loaded compression bar 510 relative to a face 706 of the cycle stop compression plate 508. A cycle stop compression plate mounting stud 708*b* connects the cycle stop compression plate 508 with the mounting plate 602.

Cycle Stop Mechanism and Operation

Figure 8:
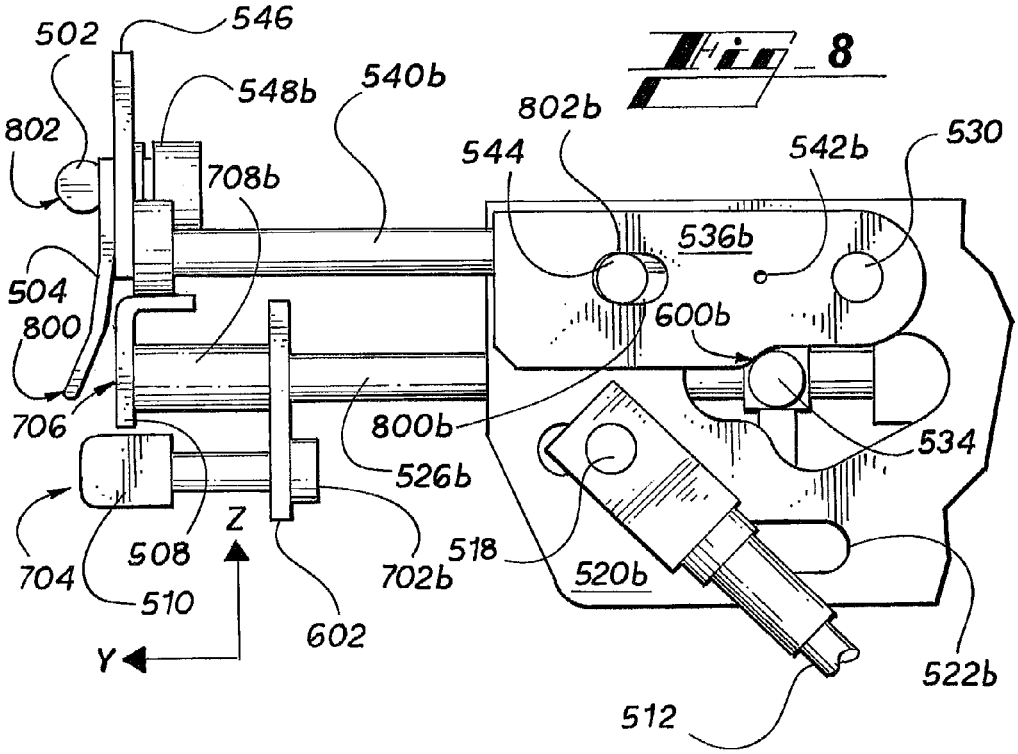
FIG. 8 is a partial side elevation view of the packaging apparatus of FIG. 5.

FIG. 8 is a side elevation view of a cross section of the packaging apparatus 500. The cross section is cut near the middle of the track bar 518 and the actuation cylinder 512 as in FIG. 6. Cartons 100, 300 transported by a conveyor will move along the front (the left side in the illustrated view) of the retaining bar 502 and the retaining guide 504. The motion of the conveyor will carry the cartons 100, 300 past the apparatus 500, i.e., away from the view shown in FIG. 8 (i.e., in the direction of the X axis, which can be seen in FIG. 5 and goes into the page in FIG. 8). During steady state packaging operations using the apparatus 500, the actuation cylinder 512 can be retracted further than is shown in FIG. 8. That is, the rod 513 of the actuation cylinder 512 can be retracted further in a downward and rightward direction in the view shown in FIG. 8.

When the actuation cylinder 512 is retracted, the track bar 518 will follow the track 522*b* to its rightmost end (the track bar also follows track 522*a* which is not shown in the view of FIG. 8). As can be seen in FIG. 5, the motion of the track bar 518 following the tracks 522*a*, 522*b* to their ends in the negative Y direction will cause the pinch blocks 524*a*, 524*b* to swing the slide arms 526*a*, 526*b* down and away from a carton 100, 300, into a standby position. The cycle stop compression plate 508, spring-loaded compression bar 510, and the slide rods 526*a*, 526*b*, (along with other elements apparent to one of skill in the art following the description given above) can rest in this standby position during steady state packaging operations.

"Steady state packaging operations" as used herein means operations where the conveyor is moving cartons past the apparatus 500 at a substantially constant speed where the apparatus applies glue to each passing carton and each carton is closed by static bars and/or guides which contact the carton as it is drawn down the conveyor line.

As noted previously, the apparatus 500 can be used to close both types of cartons, including cartons such as carton 100 and cartons such as carton 300. If the apparatus 500 is used to close cartons such as carton 100, the retaining bar 502 can contact the minor flaps 102*a*, 102*b* across a line such as that shown by line A-A' of FIG. 1 to hold them in a closed position around and/or against a product loaded into the carton 100 by machine elements upstream of the conveyor line from the apparatus 500. While the minor end flaps 102*a*, 102*b* are held in this closed position, glue can be applied to a front surface of the minor end flaps 102*a*, 102*b*. Referring to FIG. 5, glue can be applied in two beads across the minor flaps 102*a*, 102*b* at a location through the glue nozzle access hole 506 for a first bead, and at a location below the retaining guide 504 for a second bead. Further details regarding glue application will be described below. It should be noted that the retaining guide 504 is not required for some carton designs such as carton 100, and an operator can remove the retaining guide 504 for packing operations on such designs. Following the application of glue, a carton 100 can travel beyond the apparatus 500 where additional structures, such as static guides and/or folding wheels, are brought into contact with the carton 100 due to conveyor motion, which push the bottom end flap 306 against the uncured glue on the minor end flaps 102*a*, 102*b* to close the carton 100.

When the apparatus is used to pack cartons such as carton 300, cartons 300 are moved past the apparatus 500, where a front edge 800 of the retaining guide 504 contacts the cartons 300 at a point along the minor flaps 302*a*, 302*b* so as to hold the minor flaps 302*a*, 302*b* in a closed position around and/or against a product loaded into the carton 300 by machine elements upstream of the conveyor line from apparatus 500. While the minor flaps 302*a*, 302*b* are held in this closed position, glue can be applied to a front surface of the minor flaps 302*a*, 302*b*. Referring to FIG. 5, glue can be applied to the minor flaps 302*a*, 302*b* at a location below the retaining guide 504. Further details regarding glue application will be described below. Following the application of glue, the cartons 300 can travel beyond the apparatus 500 where additional structures are brought into contact with the carton 300, due to conveyor motion, which pushes the bottom end flap 306 against the uncured glue on the minor flaps 302*a*, 302*b* to close the carton 300.

If the conveyor motion is stopped during the packaging process, one or more cartons 100, 300, to which glue has been applied but that have not traveled beyond the apparatus 500, can be present on the conveyor line in front of the apparatus 500. If the conveyor line is not started again before the glue cures, these cartons 100, 300 may not be closed when the conveyor is later restarted. To prevent this undesirable occurrence, the apparatus 500 includes cycle stop features that can be used to close the bottom flaps 106, 306 of any cartons 100, 300 to which glue has been applied, but are present in front of the apparatus 500 when the conveyor motion has been stopped. The cycle stop features of the apparatus 500 are compatible with cartons such as carton 100 and cartons such as carton 300. In use with either type of carton, the cycle stop features provide means for holding the minor flaps 102*a*, 102*b*, 302*a*, 302*b* while the bottom end flap 106, 306 is folded upwardly and over the minor flaps 102*a*, 102*b*, 302*a*, 302*b* to seal the carton 100, 300.

Cycle Stop Operation

An exemplary cycle stop operation will now be described. For a cycle stop operation during packaging of cartons such as carton 100, the retaining guide 504 can be removed as it is not needed to close the carton 100. In addition, the cam bar 534 can be removed, as well as the spring loaded compression bar 510. When the conveyor is stopped, the actuation cylinder 512 can be operated to extend its length causing the articulating track bar 518 to follow the lower tracks 522*a*, 522*b*. The movement of the articulating track bar 518 will cause the slide rods 526*a*, 526*b* to first swing up into positions where they are substantially parallel to the slide rods 540*a*, 540*b* and to the Y axis. This motion will cause the cycle stop compression plate 508 to make contact with the open bottom flaps 106 of one or more unclosed cartons 100 in front of the apparatus 500, and to fold the bottom flaps 106 upwardly to a position where the bottom flaps 106 stand almost upright in front of the respective pairs of the minor flaps 102*a*, 102*b* of those cartons 100. The slide rods 540*a*, 540*b* can remain in position so that the means for holding the minor flaps, here retaining bar 502, holds the minor flaps 102*a*, 102*b* closed while the cycle stop operation is performed. Further extension of the actuation cylinder 512 causes the articulating track bar 518 to move to the leftmost end of the lower tracks 522*a*, 522*b*. This motion can cause the slide rods to slide out from the pivot blocks 528*a*, 528*b* to the left in a positive Y direction (as shown in FIG. 8) further causing the cycle stop compression plate 508 to move the bottom flaps 106 to the respective minor flaps 102*a*, 102*b*, until the bottom flaps 106 are pressed in face contacting relation against the uncured glue on their respective minor flaps 102*a*, 102*b* to close the cartons.

Another exemplary cycle stop operation will now be described. For cycle stop operation on cartons such as carton 300, the retaining guide 504, cam bar 534, and the spring loaded compression bar 510 are in place as in the configuration shown in FIG. 8. When the conveyor is stopped, one or more cartons 300, having glue applied but not yet closed, may be present in front of the apparatus 500. Here, the edge 800 of the retaining guide 504 functions as means for holding the minor flaps 302*a*, 302*b* of these cartons 300 closed. It can been seen in FIG. 8 that if the cycle stop operation were to merely function as it did for cartons 100, the cycle stop compression plate 508 would likely strike the retaining guide 504. The use of the cam bar 534 prevents this from occurring. It can be seen in FIG. 5, that the cam bar 534 will move along with the slide rods 526*a*, 526*b* during operation of the actuation cylinder 512. Referring back to FIG. 8, as the actuation cylinder 512 is extended from a retracted position, the slide rods 526*a*, 526*b* swing up into positions where they are substantially parallel to the slide rods 540*a*, 540*b* and to the Y axis. As the actuation cylinder 512 is further extended, the cam bar 534 makes contact with the bottom surface 600*a*, 600*b*, of the pivot blocks 536*a*, 536*b* causing the slide rods 540*a*, 540*b* to rotate about an axis that is located approximately at the center of the pivot bar 530, until the slide rods 540*a*, 540*b* out of the way of the forward motion (in the Y direction) of the cycle stop compression plate 508.

If a radius is drawn from the center of the pivot bar 530 to the front edge 800 of the retaining guide 504 that rotation as described above could cause the front edge 800 of the retaining guide 504 to rotate into cartons 300 that are in front of the apparatus 500. Such contact between the cartons 300 and the retaining guide 504 could result in damage to the cartons 300, the contents of the cartons 300, or in moving the cartons 300 off of the conveyor. This potential problem is alleviated by the use of means for retracting the retaining guide 504, such as the retracting track bar 544. The retracting track bar 544, as described above, follows upper tracks 545*a*, 545*b* in plates 520*a*, 520*b*. Also, as described above, the slide rods 540*a*, 540*b* have rounded notches 800*a*, 800*b* (800*a* is not visible in the perspective shown) that rest on the retracting track bar 544. As the track bar 544 follows the tracks 545*a*, 545*b*, the motion of the track bar 544 causes the slide rods 540*a*, 540*b* to retract into the pivot blocks 536*a*, 536*b*. Pivot block openings 800*a*, 800*b* can prevent this motion of the slide rods 540*a*, 540*b* from causing binding at the retracting track bar 544. Any air in the pivot blocks 536*a*, 536*b* compressed by this motion can escape through air holes 542*a*, 542*b*. The profiles of the surfaces 600*a*, 600*b*, and of the tracks 545*a*, 545*b*, are designed to keep the front edge 800 of the retaining guide 504 in contact with the minor flaps 302*a*, 302*b* for as long as possible before the retaining guide 504 is rotated out of the way to avoid contact with the cycle stop compression plate 508. It can be seen in FIG. 8, that the shape of the retaining guide 504 is designed so as to taper away from the forward motion of the cycle stop compression plate 508, to hold the minor flaps 302*a*, 302*b* of the carton 300 closed for as long as possible.

The spring loaded compression bar 510 can be set so as to make initial contact with the bottom flap 306 of the carton 300 as the slide rods 526*a*, 526*b* are extended. The compression bar 510 can help to maintain a tight closure of the minor flaps 300*a*, 300*b* as the retaining guide 504 is rotated upward.

Figure 9:
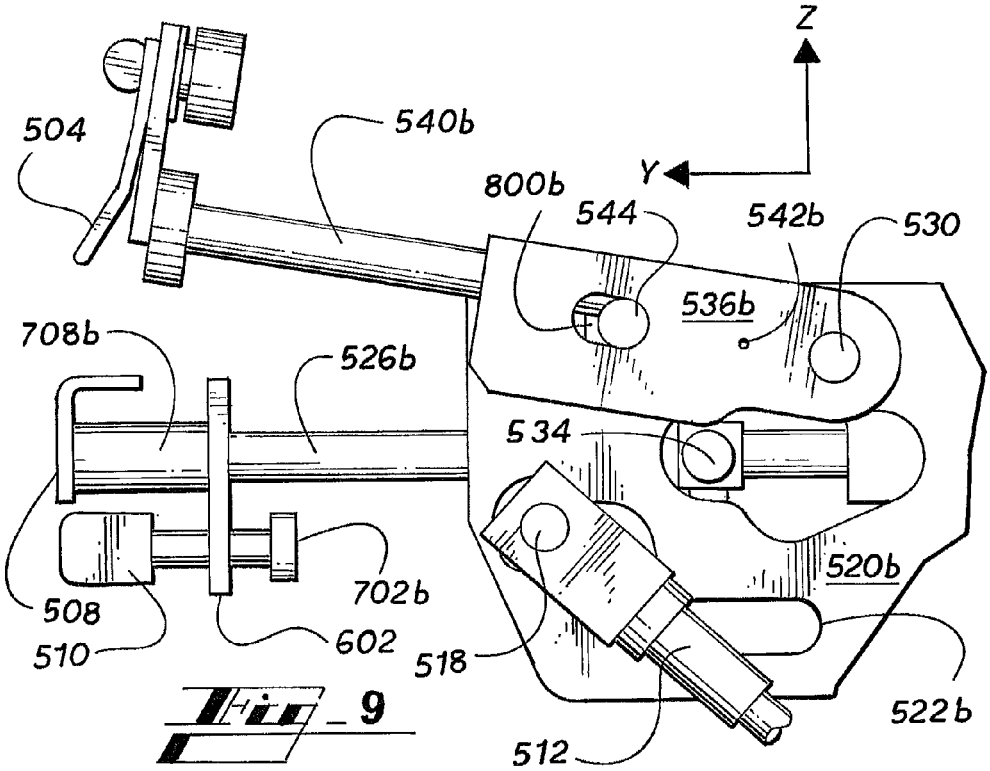
FIG. 9 is another partial side elevation view of the packaging apparatus of FIG. 5.

FIG. 9 shows a perspective sectional view of the apparatus 500 where the actuation cylinder 512 is at substantially full extension, placing the track bar 518 at the leftmost end of the tracks 522*a*, 522*b*. The retaining guide 504 is shown having been rotated and retracted out of the way due to the movement of the cam bar 534 contacting the pivot blocks 536*a*, 536*b* and the track bar 544 retracting the slide rods 540*a*, 540*b* into the pivot blocks 536*a*, 536*b*.

Glue Delivery

Due to the taller minor end flaps 102*a*, 102*b* of carton 100, two glue beads can be used to close its end flaps 102*a*, 102*b*. In contrast, only a single glue bead is used to close the shorter end flaps 300*a*, 300*b* of the carton 300.

Figure 10:
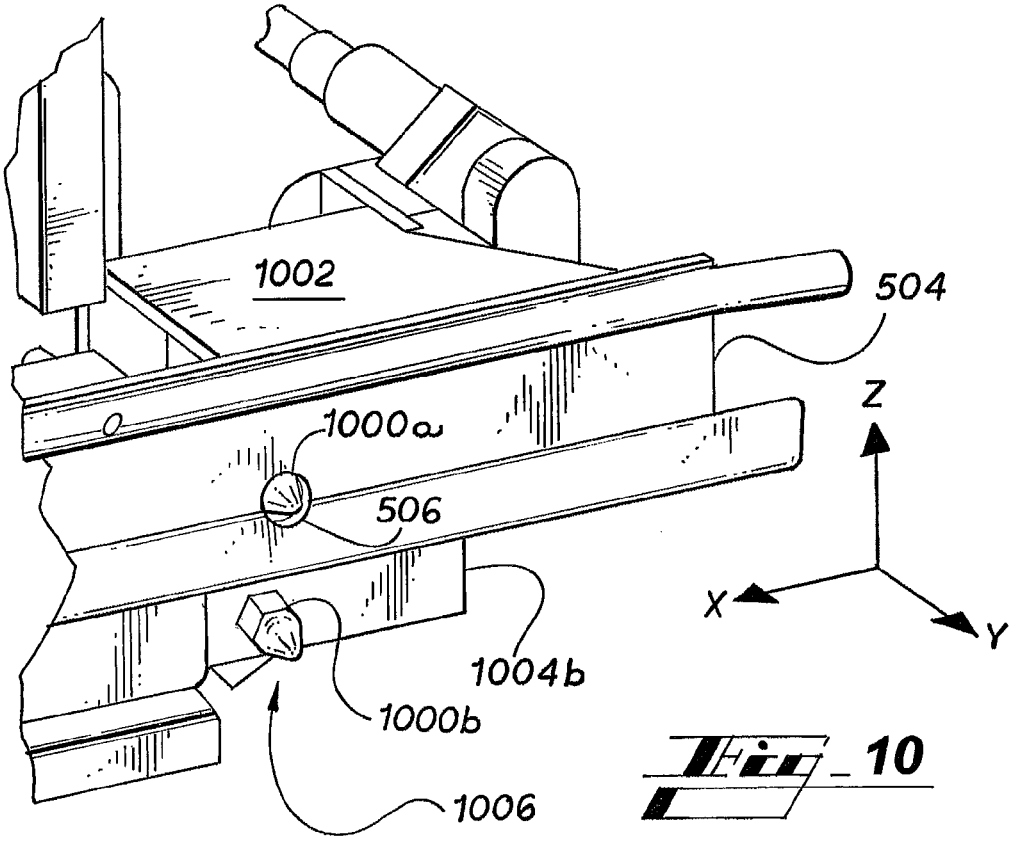
FIG. 10 is a partial perspective view from the front of the packaging apparatus of FIG. 5 showing the glue nozzles in a vertical orientation.
Figure 15:
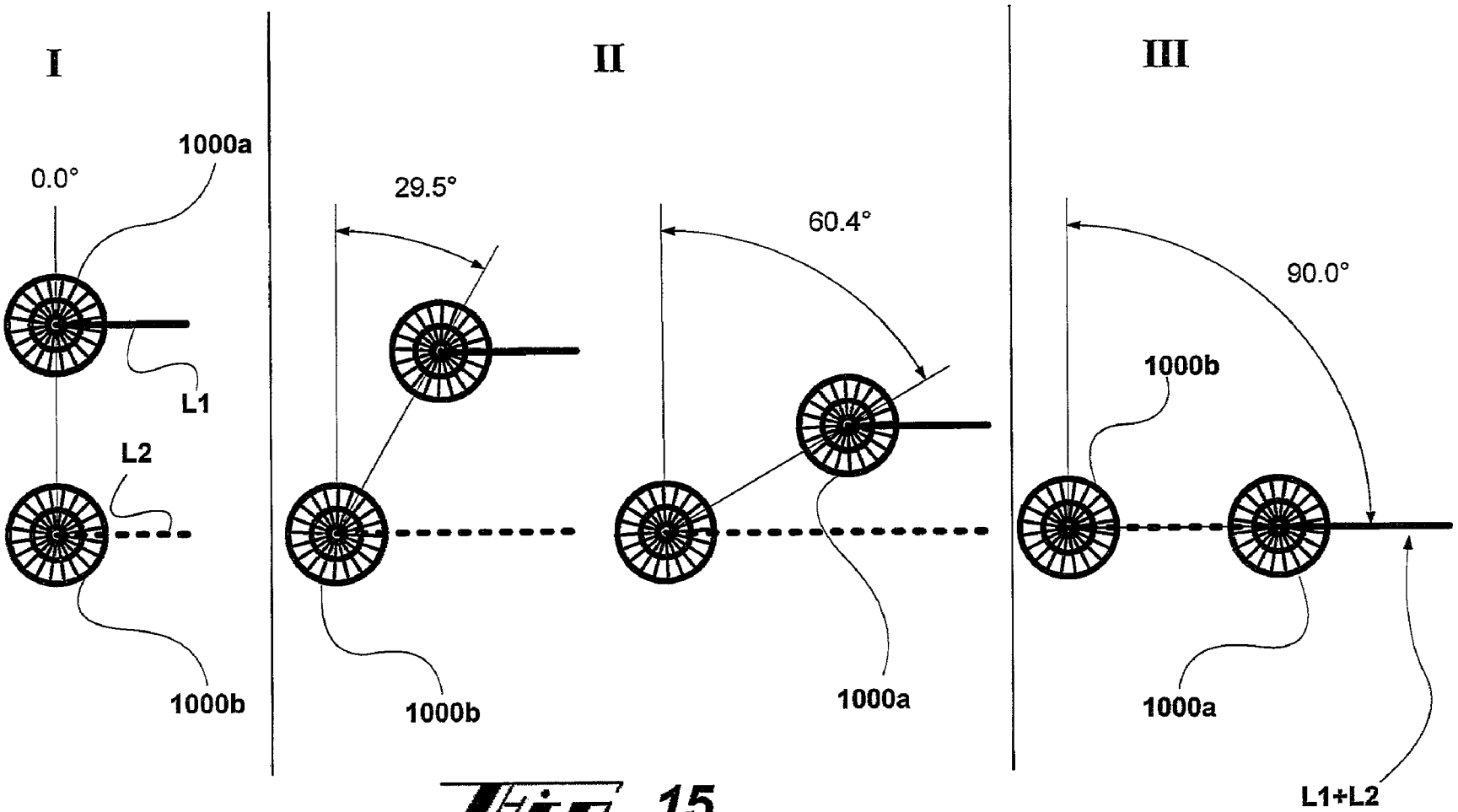
FIG. 15 illustrates the variable spacing between lines of glue achieved by rotating an arrangement of glue nozzles.

FIG. 10 shows a glue nozzle arrangement that can be used for the apparatus 500 when the apparatus 500 is configured for packaging operations for cartons such as carton 100. Two glue nozzles 1000*a*, 1000*b* are positioned such that an imaginary line drawn between their outlets is substantially parallel to the Z axis. The glue nozzles 1000*a*, 1000*b* can be actuated to each provide a bead of glue L1, L2 (shown in FIG. 15) across each of the minor end flaps 102*a*, 102*b* as the conveyor brings them past, resulting in two beads of glue L1, L2 on each minor flap 102*a*, 102*b* as cartons 100 pass by the apparatus 500 on a conveyor. A glue nozzle access hole 506 is provided in the retaining guide 504. The access hole 506 is an aperture, slot, or other opening that may be elongated and curved to coincide with the rotation of the glue nozzle 1000*a*. The glue guns 1004*a*, 1004*b* (1004*a* is not visible in the view provided by FIG. 10) are mounted to the glue gun assembly bracket 1002.

Where the packaging apparatus 500 is configured for use with cartons such as carton 300, only one bead of glue is needed on each of the end flaps 302*a*, 302*b*. To apply a single bead of glue L1 on each of the minor end flaps 300*a*, 300*b*, the upper nozzle 1000*a* could merely be disabled such that it does not dispense glue, with the lower nozzle 1000*b* dispensing a single bead of glue L2 on each of the minor flaps 302*a*, 302*b*. Leaving one glue nozzle 1000*a*, 1000*b* idle, however, can result in burning and/or charring of the glue in the idle nozzle 1000*a*, 1000*b*. This can lead to clogging of a glue nozzle 1000*a*, 1000*b*.

Figure 11:
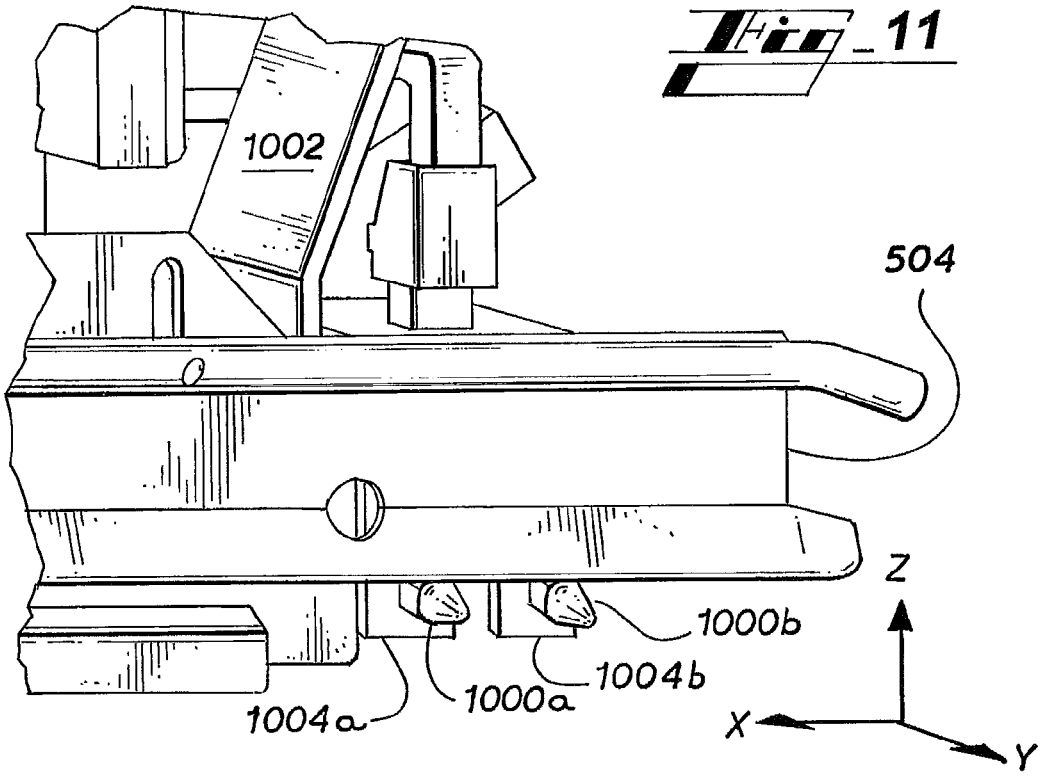
FIG. 11 is another partial perspective view from the front of the packaging apparatus of FIG. 5 showing the glue nozzles in a horizontal orientation.

The present disclosure overcomes this problem by introducing a rotating glue application assembly 1006, which is shown, although partially obstructed, in FIG. 10. As used herein, the term rotating indicates that the assembly 1006 is capable of rotating to change the orientation of the arrangement of nozzles 1000*a*, 1000*b*. In FIG. 10, the rotating glue application assembly 1006 is positioned so that glue nozzles 1000*a*, 1000*b* are oriented vertically for applying two glue beads spaced apart by the vertical distance between the nozzles 1000*a*, 1000*b*. FIG. 11 shows the assembly 1006 positioned so that the nozzles 1000*a*, 1000*b* are both located below the retaining guide 504. The nozzles in this configuration are oriented horizontally, an imaginary line drawn between their outlets being substantially parallel to the X axis. To prevent burned glue from clogging a glue nozzle 1000*a*, 1000*b*, each of the glue nozzles 1000*a*, 1000*b* are used to place a respective bead of glue onto the minor flaps 300*a*, 300*b* of the carton 300 as it moves past on the conveyor. The timing of the glue dispensing of the glue guns 1004*a*, 1004*b* can be set so that glue gun 1004*a* places a single bead on minor flap 302*b* and glue gun 1004*b* places a single bead on minor flap 302*b*.

Figure 12:
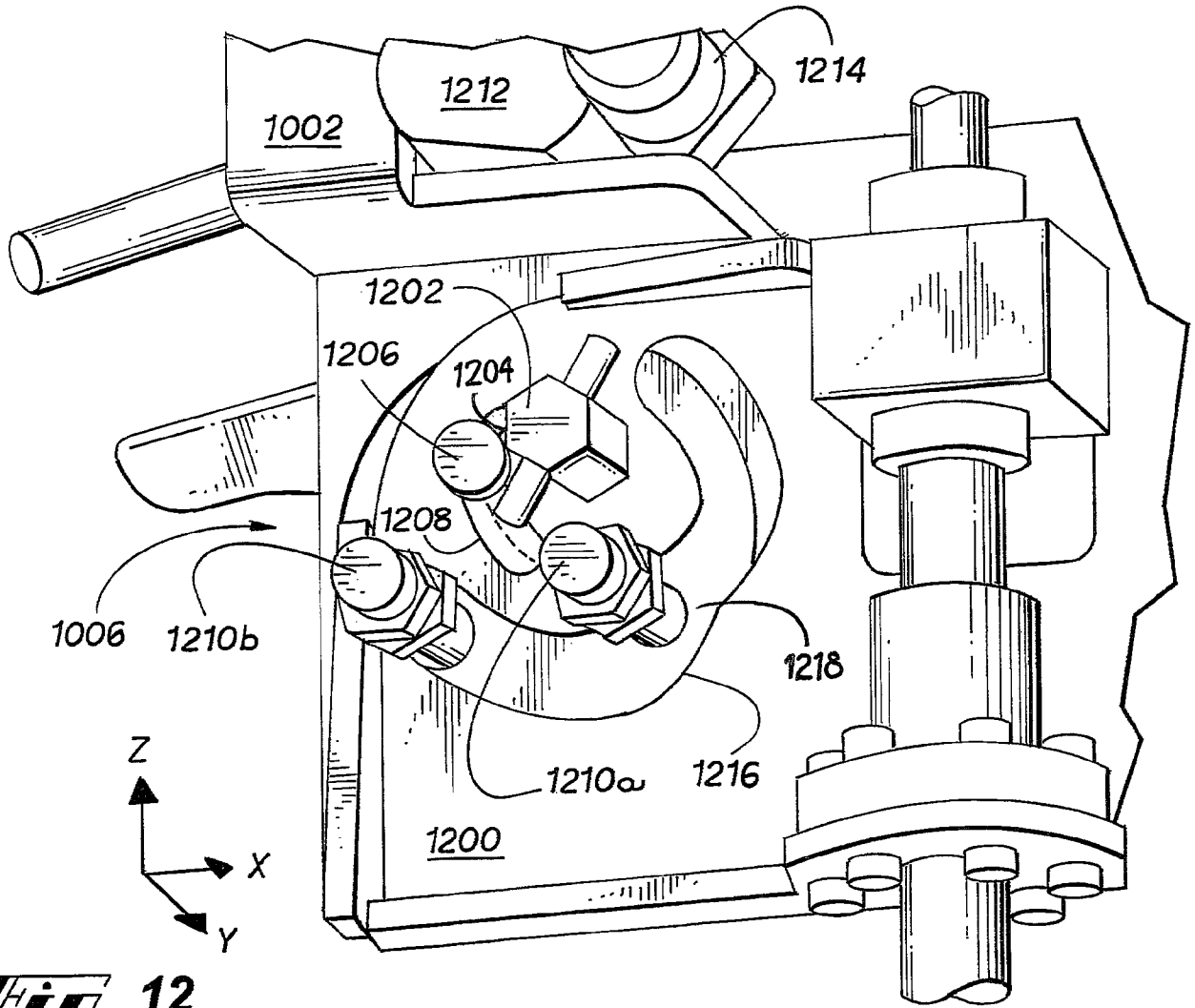
FIG. 12 is a partial perspective view from behind the packaging apparatus of FIG. 5 showing the glue nozzles in a horizontal orientation.

FIG. 12 shows a perspective view of the rotating glue gun assembly 1006 from a viewing position located behind the glue guns 1004*a*, 1004*b*. In the view shown, the assembly 1006 is rotated as it is in FIG. 11, that is, with the glue nozzles 1000*a*, 1000*b* in a horizontal orientation. From the perspective of FIG. 12, features of the static mounting bracket 1200 and the glue gun assembly bracket 1002 that enable rotation of the glue gun assembly can be seen. The static mounting bracket 1200 includes grooves 1204 and 1208. The grooves have a width that is capable of accepting shafts of the glue gun assembly retention bolt 1202 and the retention tab 1206. It should be understood that the retention bolt 1202 can alternatively include a retention nut which threads onto a shaft of the glue gun assembly bracket 1002. The retention bolt 1202 can optionally have a non-threaded initial section beyond the bolt head having a non-threaded length less than the thickness of the static mounting bracket 1200. The non-threaded portion can have a diameter that is slightly less than the width of the groove 1204. The sides of groove 1204 can contact the unthreaded portion (rather than the threaded portion) of the retention bolt 1202 during rotation of the glue gun assembly to reduce play and to ensure that the threads of the retention bolt 1202 are not damaged.

A retention tab 1206 with a head portion and a shaft portion can be included. The head portion has a diameter greater than the groove 1208 so as to hold the glue gun assembly in the groove 1208, and a face of the glue gun assembly bracket 1002 substantially flush with a face of the static mounting bracket 1200. A washer or pad 1218 can be placed between the glue gun assembly bracket 1002 and the static mounting bracket 1200.

When tightened, the retention bolt 1202 holds the glue gun assembly in place to prevent rotation. When the retention bolt 1202 is loosened, the glue gun assembly can be rotated in a path defined by the movement of the retention bolt 1202 and the retention tab 1206 in the grooves 1204 and 1208, respectively. Static mounting bracket 1200 material is removed from an area 1216 to permit rotation of the glue gun assembly, preventing the static mounting bracket 1200 from interfering with the pneumatic valve plumbing 1210*a*, 1210*b* of the glue guns 1004*a*, 1004*b*. The glue guns 1004*a*, 1004*b*, the glue gun assembly bracket 1002, a glue input 1214, and a glue heater 1212 can all rotate with the rotation of the glue gun assembly.

Figure 13:
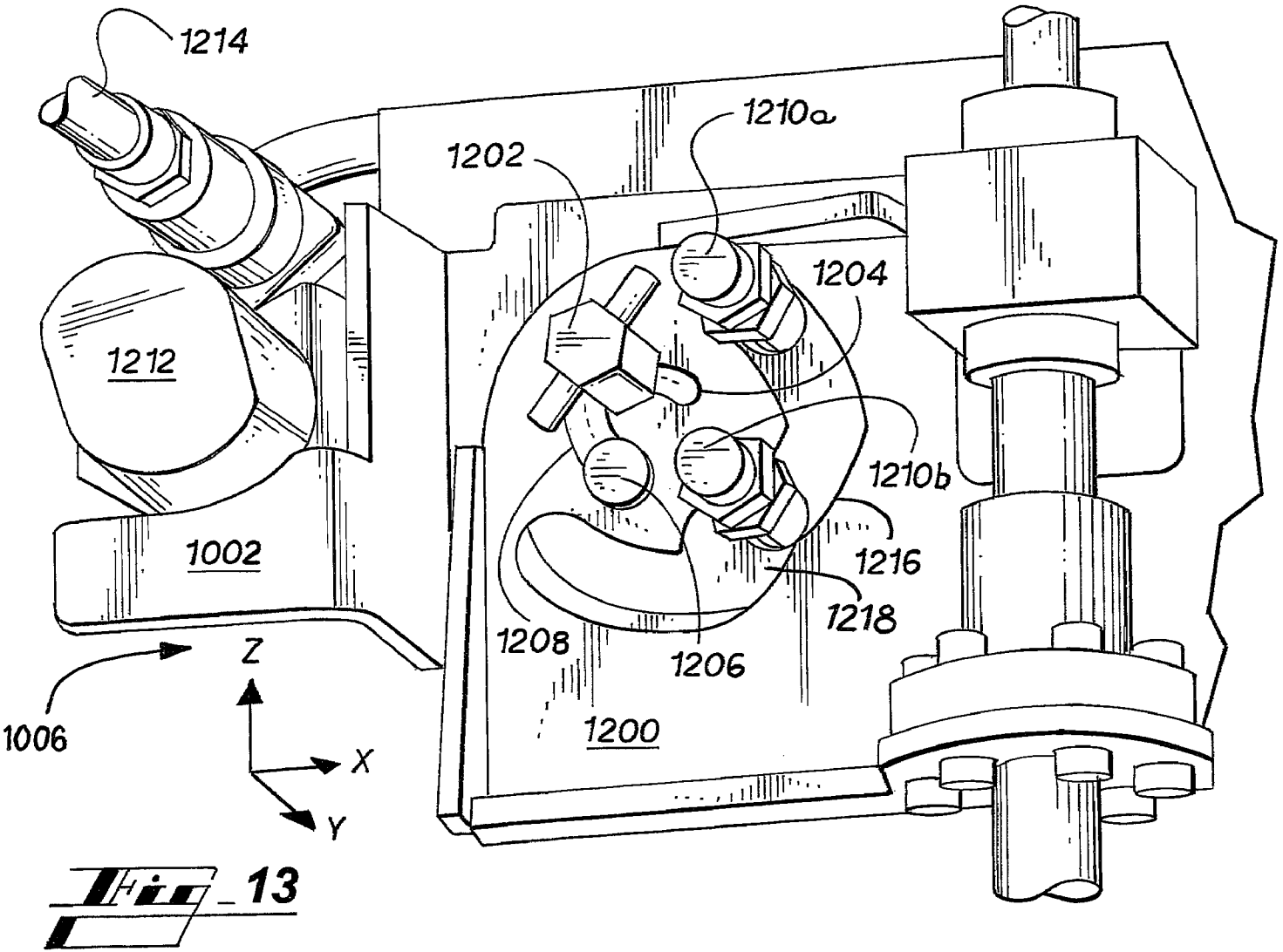
FIG. 13 is another partial perspective view from behind the packaging apparatus of FIG. 5 showing the glue nozzles in a horizontal orientation.
Figure 14:
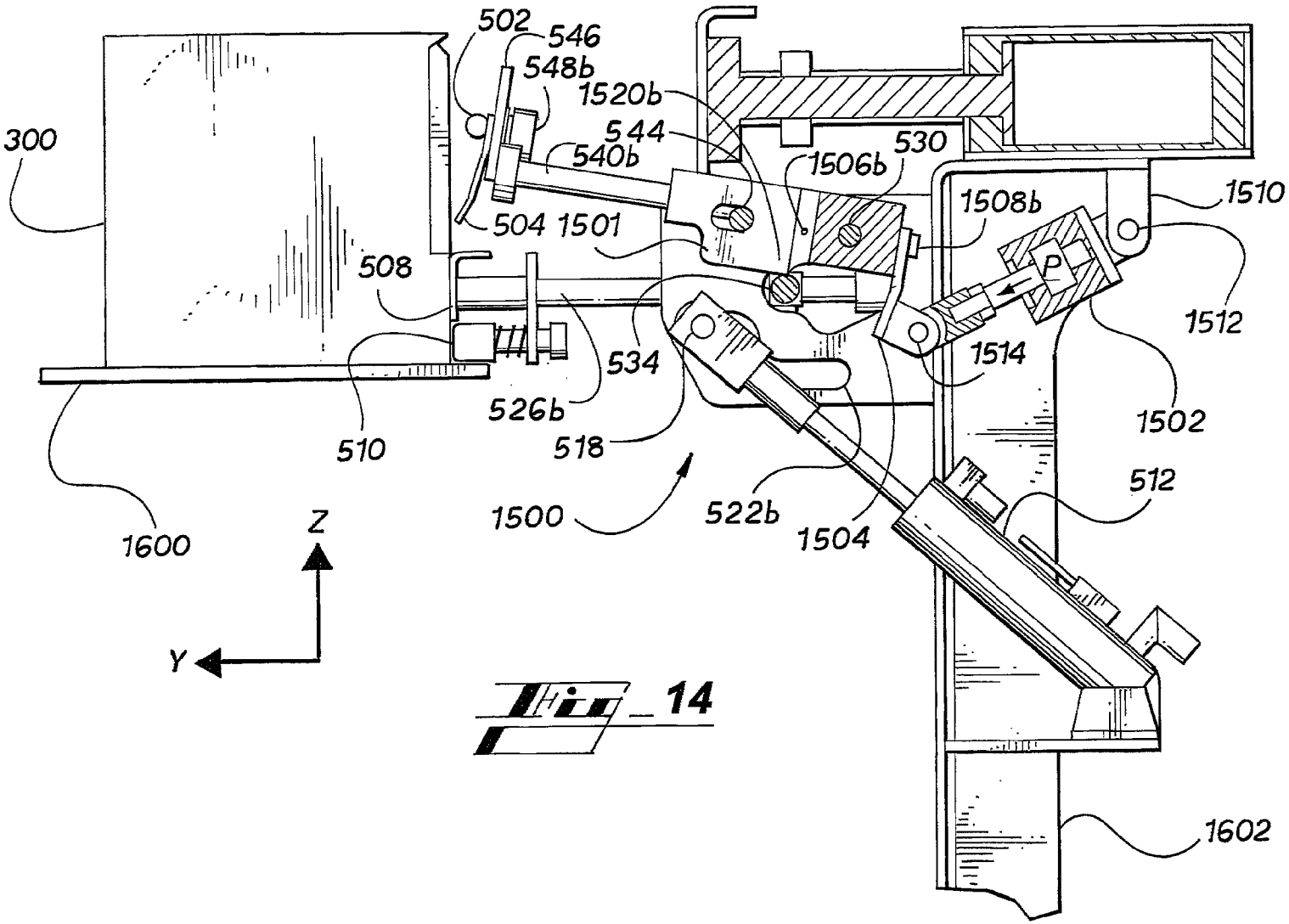
FIG. 14 is a side elevation view of a packaging apparatus according to an alternate exemplary embodiment of the disclosure showing the retaining guide is in a rotated position.

FIG. 13 shows a close up perspective view of the glue gun assembly 1006 where the glue gun assembly 1006 is rotated to a position where the glue gun nozzles 1000*a*, 1000*b* have a horizontal orientation. FIG. 14 shows a close up perspective view of the glue gun assembly 1006 where the glue gun assembly is rotated to a position where the glue gun nozzles 1000*a*, 1000*b* have a vertical orientation.

The grooves 1204 and 1208 and the area 1216 permit 90 degrees of rotation of the glue gun assembly. The glue gun assembly 1006 need not be set at the extremes of rotation, as shown as first orientation I and third orientation III in FIG. 15. Alternatively, intermediate angles of rotation, examples of which are shown as second orientation II, allow the apparatus to apply glue beads L1, L2 having adjustable spacing. Where the glue gun nozzles 1000*a*, 1000*b* have a horizontal orientation, they each apply a glue bead L1, L2 to cooperatively define a single composite line of glue L1+L2. Rotating the glue gun assembly varies the spacing of the applied beads L1, L2 from a minimum spacing, when the glue nozzles 1000*a*, 1000*b* are in a horizontal orientation, to a maximum spacing when the glue nozzles are in a vertical orientation.

Alternative Cycle Stop Mechanism and Operation

An alternative embodiment of a packaging apparatus 1500 is shown in FIG. 14. The structure and operation of apparatus 1500 is substantially similar to that of apparatus 500. The elements and operations of apparatus 1500 that differ from the embodiment discussed above will be described here.

The apparatus 500 employs a single actuation cylinder 512. In some cases the force needed to swing the cycle stop compression plate 508 up following the tracks 522*a*, 522*b* and subsequently lift the retaining guide 504 and slot rods 540*a*, 540*b* through contact of the cam bar 534 with the pivot blocks 536*a*, 536*b* can be so great so as to cause the cycle stop compression plate 508 to contact the bottom flap of a carton more abruptly than is desirable. The apparatus 1500 requires less force to be applied by the actuation cylinder 512 so that a gentler contacting of the cycle stop compression plate 508 against the carton can be achieved.

Apparatus 1500 includes a second actuation cylinder, a retaining guide actuation cylinder 1502 that can control the rotation of pivot block 1501, the slot rods 540*a*, 540*b*, and the retaining guide 504. The two pivot blocks 536*a*, 536*b* of apparatus 500 are replaced in apparatus 1500 with the single pivot block 1501. The pivot block 1501 includes air holes 1506*a*, 1506*b* to permit air to escape during sliding of the slot rods 540*a*, 540*b* into and out of the tunnels in the pivot block 1501. Bolts 1508*a*, 1508*b* hold bracket 1504 to the back of the pivot block 1501. A first end of the retaining guide actuation cylinder 1502 pivotally connects to the bracket 1504 at a pivot point 1514. A second end of the actuation cylinder 1502 pivotally connects to an attachment bracket 1510 at a pivot point 1512.

During steady-state carton loading operations, the cycle stop compression plate 508 remains in a lowered position. When an operator of the packaging apparatus 1500 initiates a cycle stop operation due to a conveyor stoppage, or some other non-emergency event such as no remaining product to be loaded or a low amount of non-erected cartons in the carton hopper, the actuation cylinder 512 extends and the track bar 518 follows tracks 522*a*, 522*b*. This movement of the track bar 518 causes the cycle stop compression plate 508 to swing up until the slide rods 526*a*, 526*b* become substantially parallel to the slide rods 540*a*, 540*b*. The cam bar 534 then contacts the surfaces 1520*a*, 1520*b* of the pivot block 1501. The movement of the track bar 518 in the tracks 522*a*, 522*b* is then halted by the cam bar making contact with the surfaces 1520*a*, 1520*b*. The pivot block 1501 is held in place by a force exerted by the retaining guide actuation cylinder 1502 in a negative P direction (as shown on the actuation cylinder 1502). Therefore, the cam bar 534 of the apparatus 1500 acts as a latch to prevent further movement of the cycle stop compression plate 508 once the cam bar 534 makes contact with the surfaces 1520*a*, 1520*b*.

For movement of the cycle stop compression plate 508 to continue toward the cartons 100, 300 on the conveyor, the actuation cylinder 1502 releases the pressure applied in the negative P direction and applies a force in the positive P direction to rotate the retaining guide 504 up and out of the way of the cycle stop compression plate. The slide rods 540*a*, 540*b*, retract into the pivot block 1501 to prevent the retaining guide 504 from striking cartons during its upward rotation. The retraction is implemented by the track bar 544 as described above regarding apparatus 500.

The actuation cylinder 512 and the actuation cylinder 1502 can be pneumatic cylinders, in which case the relative air pressures used in the actuation cylinders 512, 1502 can be adjusted for proper operation. The apparatus 1500 permits the use of a lower air pressure in the actuation cylinder 1502 than that used in an actuation cylinder 512 of the apparatus 500 the force required from this cylinder is reduced due to it no longer being required to lift the retaining guide 504 through the movement of the cam bar 534. Instead, the cam bar 534 acts as a latch and the retaining guide 504 is rotated by the operation of the actuation cylinder 1502. Using a lower pressure in the actuation cylinder 512 can be desirable as use of lower pressure can prevent the cycle stop compression plate 508 from slamming abruptly into cartons 100, 300 on the conveyor.

FIG. 14 also shows the apparatus 1500 in relation to a conveyor 1600 transporting a carton 300. The apparatus 1500 is mounted to the packaging machine 1602. The packaging machine 1602 can include additional elements that perform carton packing functions both upstream and downstream of the conveyor path of the apparatus 1500. The apparatus 500 can be similarly positioned relative to a conveyor.

The above-described embodiments are merely exemplary illustrations of implementations set forth for a clear understanding of the principles of the disclosure. Variations, modifications, and combinations may be made to the above-described embodiments without departing from the scope of the claims. For example, those skilled in the art will readily appreciate that glue may be applied in continuous or broken lines, or as dots, and thus, that all reference to beads of glue should be construed in the context of a rapidly moving serial process in that even intermittent dots of glue, in the aggregate, will approximate lines. All such variations, modifications, and combinations are included herein by the scope of this disclosure and the following claims.

What is claimed is:

1. A packaging apparatus in an automated packaging process, for sealing a carton having minor flaps and a bottom end flap, comprising:

means for holding the minor flaps in a closed position, said mean for holding the minor flaps comprising a retaining guide; a cycle stop compression plate for, upon the occurrence of a cycle stop operation, folding the bottom end flap over the minor flaps and holding the bottom end flap in place until the carton is sealed; an actuation cylinder configured to extend upon occurrence of a cycle stop operation to move the cycle stop compression plate so as to fold the bottom end flap; at least one pivot block associated with the retaining guide; and a cam bar associated with the actuation cylinder and contacting the at least one pivot block so as to translate the extension of the actuation cylinder upon occurrence of a cycle stop into motion that pivots the retaining guide to avoid interfering with the cycle stop compression plate folding the bottom end flap of the carton and wherein in absence of the occurrence of a cycle stop operation, the retaining guide is positioned between the cycle stop compression plate and the carton.

2. The packaging apparatus of claim 1, further comprising means for retracting the retaining guide as it pivots to avoid binding on the carton.

3. The packaging apparatus of claim 2, wherein means for retracting the retaining guide comprises:

at least one slide rod associated with the retaining guide;

at least one upper track; and a retracting track bar in contact with the at least one slide rod and extending through the at least one upper track so as to retract the at least one slide rod into the at least one pivot block in response to the pivoting motion of the retaining guide.

4. The packaging apparatus of claim 1, wherein means for holding the minor flaps comprises a retaining bar.

5. The packaging apparatus of claim 1, further comprising:

at least one lower track; and an articulating track bar associated with the actuation cylinder and the compression plate, the articulating track bar extending through the at least one track so as to translate the extension of the actuation cylinder into the motion needed to fold the bottom end flap upwardly and into face contacting relation to the minor flaps.

6. The packaging apparatus of claim 5, further comprising a spring loaded compression bar for applying pressure to the bottom end flap to maintain a tight closure of the minor flaps as the bottom end flap is folded.

* * * * *